US011759080B2

(12) United States Patent
Vernazza

(10) Patent No.: US 11,759,080 B2
(45) Date of Patent: Sep. 19, 2023

(54) DEVICE FOR CLEANING SURFACES

(71) Applicant: IP CLEANING S.R.L., Venice (IT)

(72) Inventor: Giulio Vernazza, Fontanellato (IT)

(73) Assignee: IP CLEANING S.R.L., Portogruaro (IT)

( * ) Notice: Subject to any disclaimer, the term of this patent is extended or adjusted under 35 U.S.C. 154(b) by 631 days.

(21) Appl. No.: 16/966,813

(22) PCT Filed: Jan. 30, 2019

(86) PCT No.: PCT/IB2019/050758

§ 371 (c)(1),
(2) Date: Jul. 31, 2020

(87) PCT Pub. No.: WO2019/150283

PCT Pub. Date: Aug. 8, 2019

(65) Prior Publication Data

US 2020/0359870 A1 Nov. 19, 2020

(30) Foreign Application Priority Data

Jan. 31, 2018 (IT) ..... 102018000002285

(51) Int. Cl.
*A47L 11/30* (2006.01)
*A47L 11/40* (2006.01)

(52) U.S. Cl.
CPC ..... *A47L 11/305* (2013.01); *A47L 11/4044* (2013.01); *A47L 11/4052* (2013.01); *A47L 11/4075* (2013.01)

(58) Field of Classification Search
CPC ..... A47L 11/305; A47L 11/4044; A47L 11/4052; A47L 11/4075
See application file for complete search history.

(56) References Cited

U.S. PATENT DOCUMENTS

| | | | | |
|---|---|---|---|---|
| 5,347,678 | A | 9/1994 | Williams | |
| 7,392,566 | B2 * | 7/2008 | Gordon | A47L 5/30 15/322 |
| 7,552,507 | B2 | 6/2009 | Burnham | |
| 7,870,638 | B2 * | 1/2011 | Jansen | A47L 9/0494 15/322 |

FOREIGN PATENT DOCUMENTS

| | | |
|---|---|---|
| EP | 1452120 A1 | 9/2004 |
| WO | 2014199216 | 12/2014 |

* cited by examiner

*Primary Examiner* — David Redding
(74) *Attorney, Agent, or Firm* — Maschoff Brennan

(57) ABSTRACT

A machine for cleaning surfaces comprises a main body and a handle portion configured to move the main body along a determined advancing direction. The main body is equipped with a cleaning brush positioned adjacent to the surface to be cleaned, and a first and a second squeegee element positioned at opposite sides of the cleaning brush. The main body provides, furthermore, a first and a second suction mouth positioned at the first and the second squeegee element, respectively, connected to a suction device by a suction circuit. This comprises a deviation device configured to alternately and selectively pneumatically connect the first suction mouth, or the second suction mouth and the suction device, and to pneumatically disconnect, instead, the other suction mouth.

23 Claims, 15 Drawing Sheets

Fig. 3
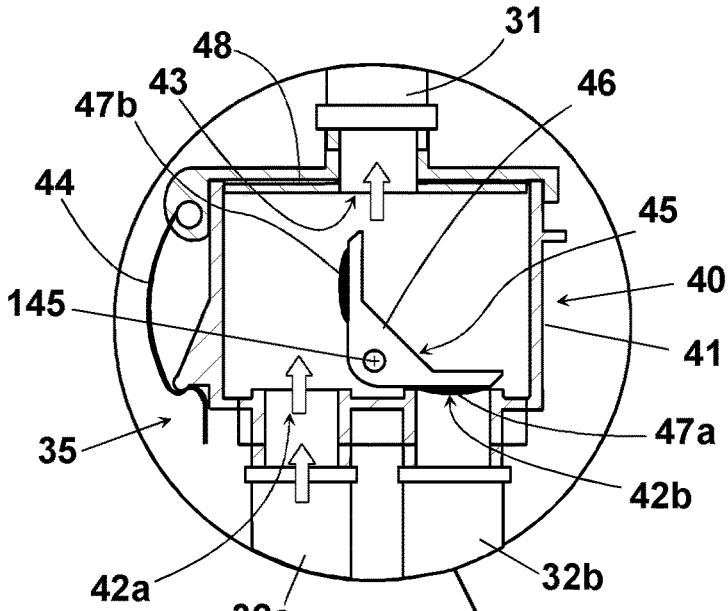
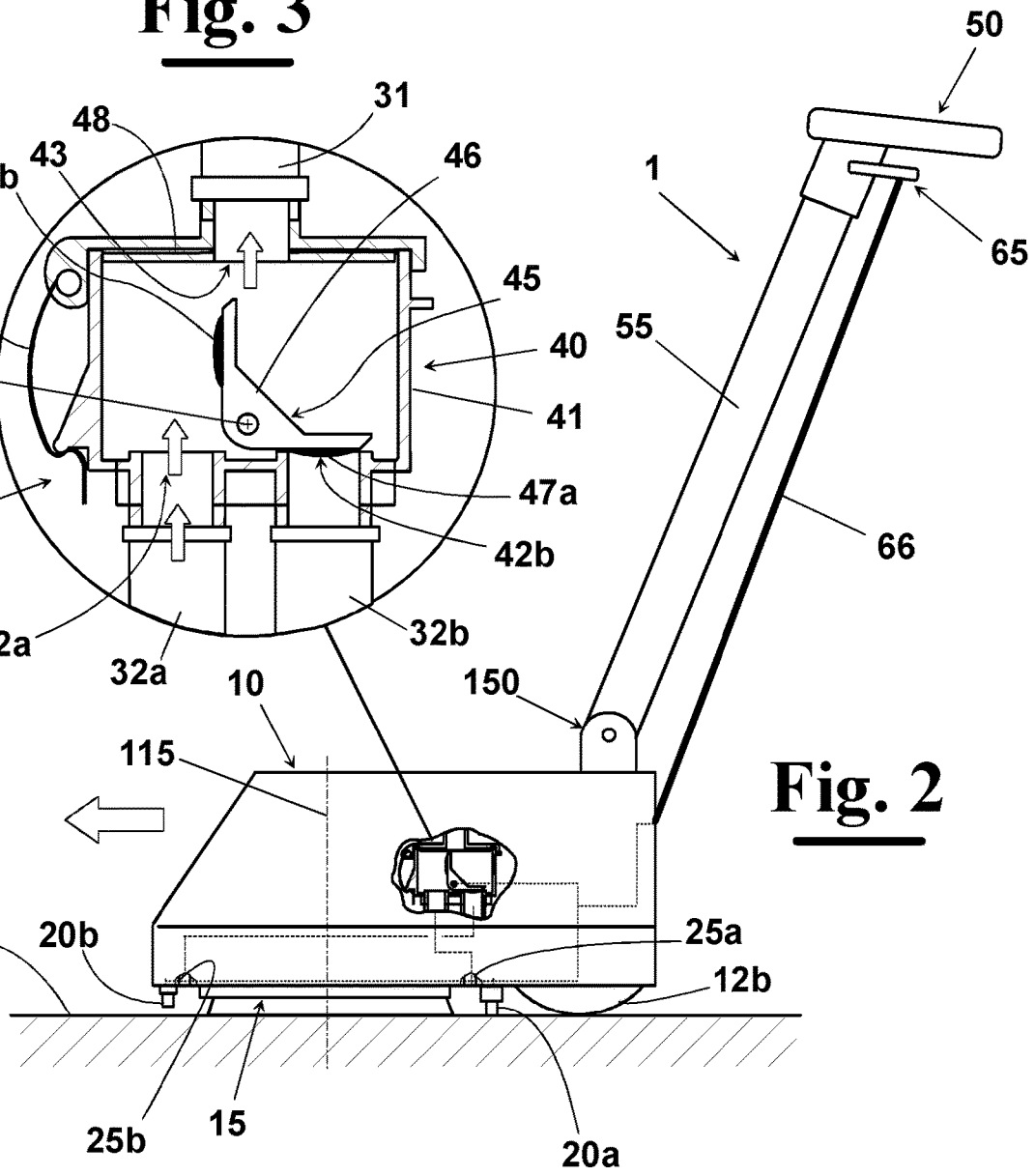
Fig. 2

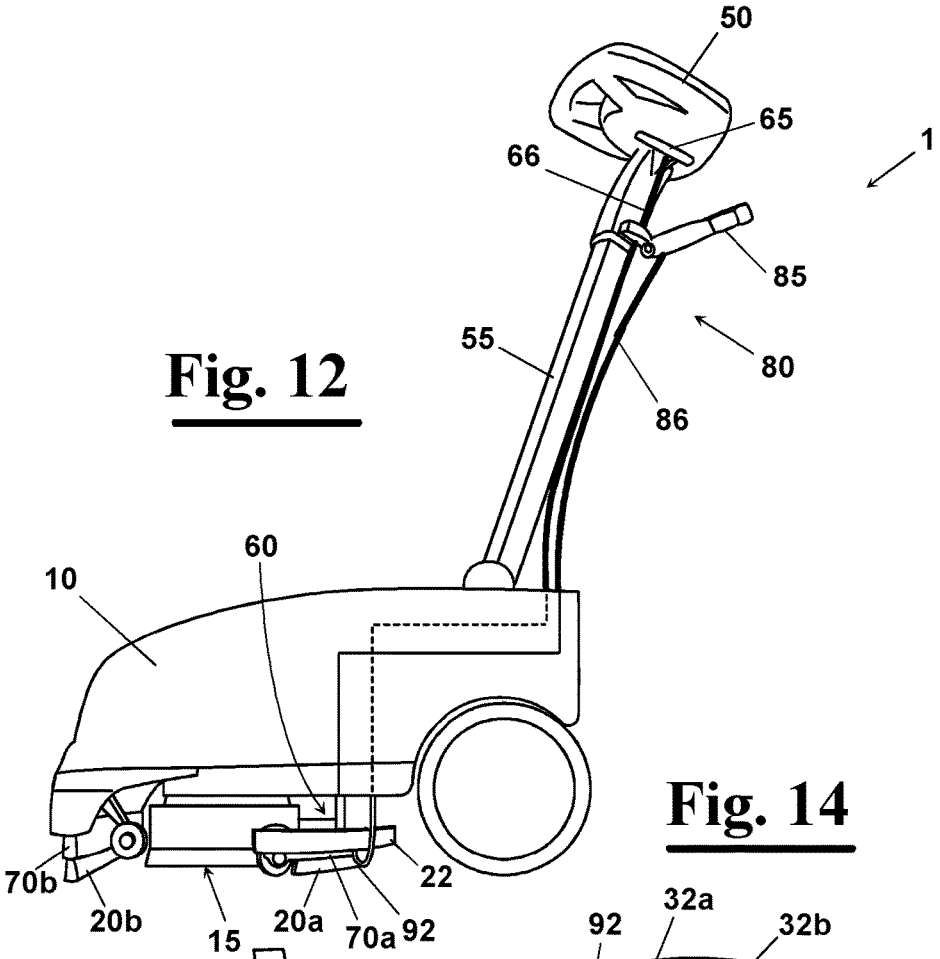
Fig. 12
Fig. 14
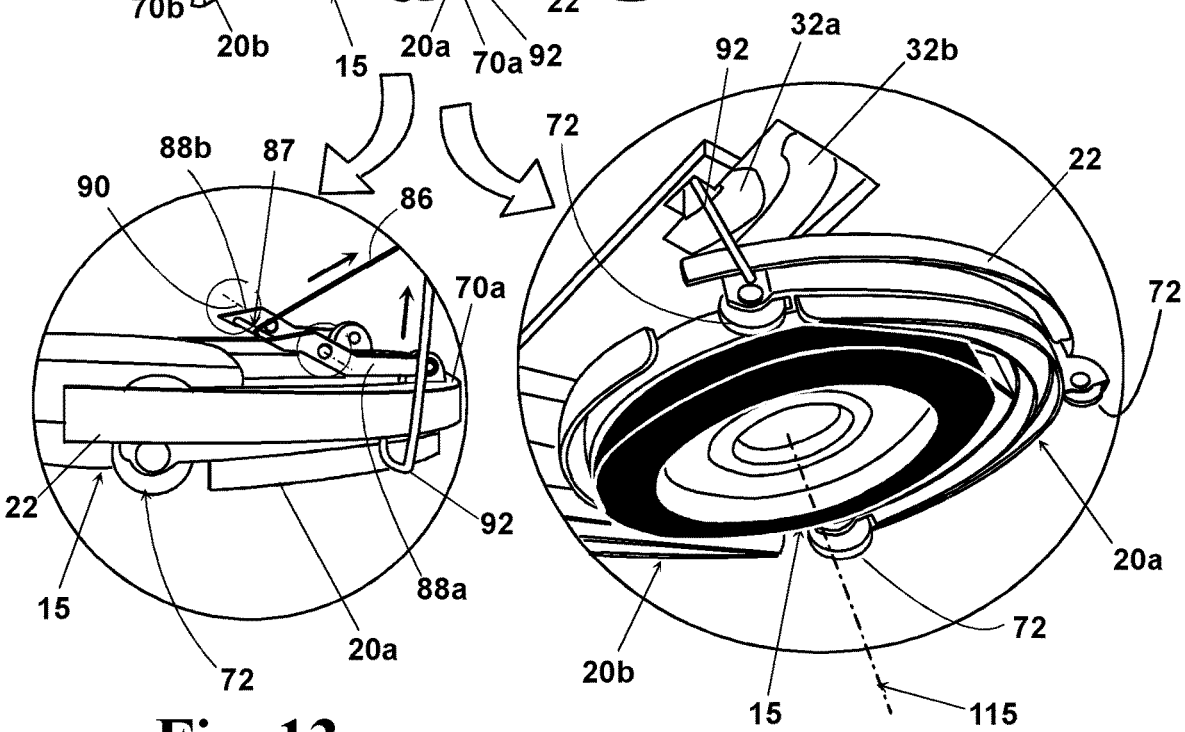
Fig. 13

Fig. 16
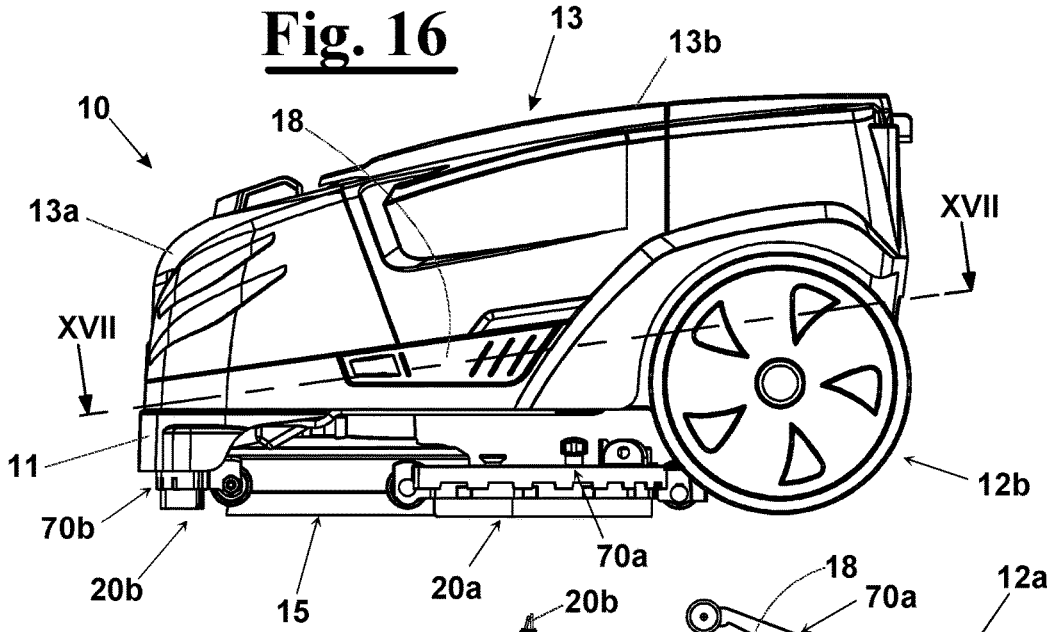
Fig. 17
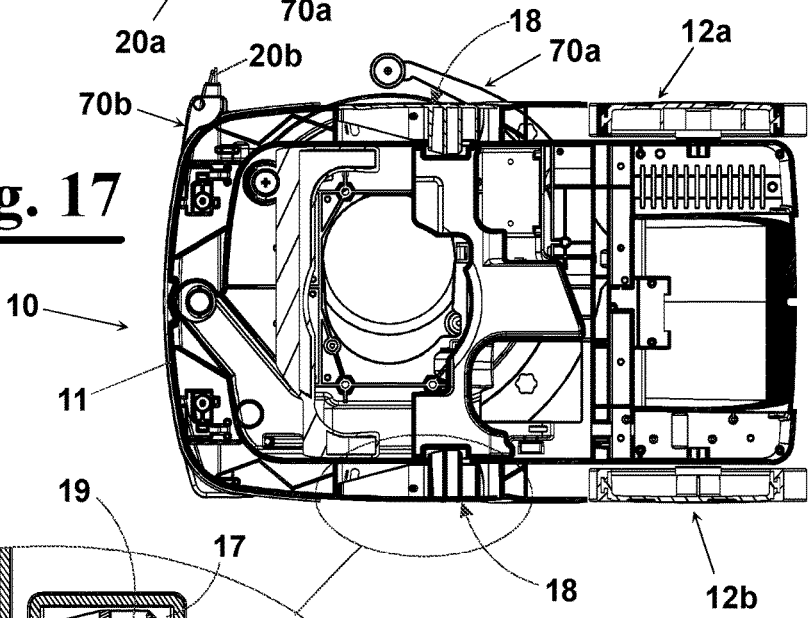
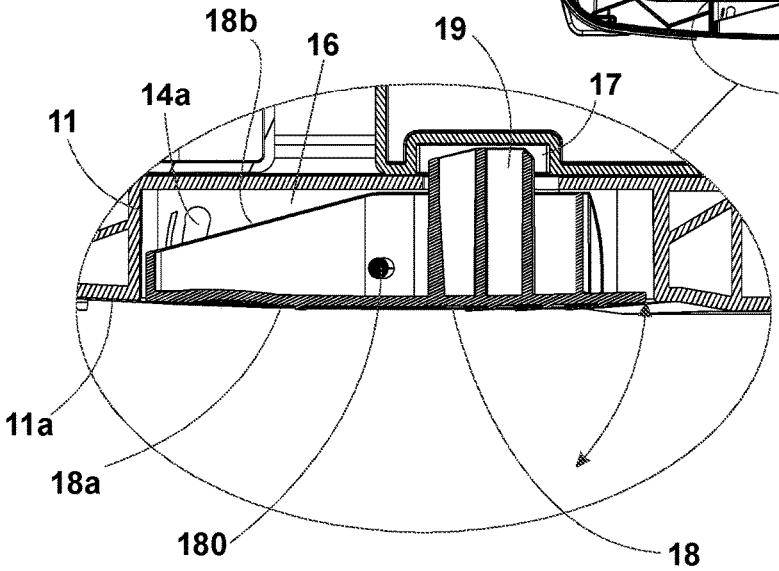
Fig. 18

DEVICE FOR CLEANING SURFACES

FIELD OF THE INVENTION

The present invention relates to the technical field of the machines for cleaning and washing floors, and in particular the present invention relates to a scrubber machine for floors of improved type.

DESCRIPTION OF THE PRIOR ART

As known, many typologies exist of machines for cleaning floors that are able to wash the surface to be cleaned by delivering a detergent liquid and then sucking the dirty liquid. Normally, a machine of this type provides a rotating brush on which the detergent liquid contained in a storage container is delivered. The dirty liquid is, then, sucked from the floor by a suction mouth positioned behind the rotating brush along the advancing direction of the machine. In order to make the cleaning action more effective, downstream of the rotating brush a cleaning blade, or squeegee element, is provided.

This typology of machines for cleaning floors, however, has the drawback that when the direction of motion is reversed, i.e. when the machine is moved backward, instead of being moved forward, the washing liquid is not sucked up by the suction mouth, because this is positioned upstream of the rotating brush.

Scrubber machines for floors also exist that provide 2 suction mouths, one of which positioned downstream and the other one positioned upstream of the rotating brush, along the advancing direction. More precisely, these scrubber machines provide that the 2 suction mouths are pneumatically connected to the same suction device and that are always in a suction mode. In this way, it is possible to suck the dirty liquid up from the floor, both when the machine is moved forward, and when the machine is moved backward. However, the contemporary suction both upstream and downstream of the rotating brush does not allow to clean the floor in a satisfactory way with only one passage of the machine and, therefore, it is necessary to move the brush several times on the same area of the floor, in order to guarantee a satisfactory cleaning, thus losing a lot of time and of detergent liquid.

Furthermore, scrubber machines exist providing 2 suction mouths that are alternately opened and closed by a respective closing and opening element positioned at each of them.

As for example described in WO2014199216, each opening and closing element normally provides a plate mounted at the suction mouth and that, during the movement of the machine on the floor, is forced by the surface of the floor to which is adjacent, towards the suction mouth to which is associated, in order to close it, or in the opposite direction, in order to open it. In particular, the above mentioned plates are mounted in such a way to open the respective suction mouth when the same is positioned downstream of the brush along the advancing direction of the machine, and to close the same suction mouth when this is positioned upstream of the brush.

However, also this solution is not completely satisfactory, because with time the opening and closing plates of the mouths can warp and, therefore, be no more able to effectively close and open the respective suction mouth. Furthermore, the plates rubbing against the surface can scratch the floor.

Another known solution is, for example, described in U.S. Pat. No. 5,347,678. In this case, a control mechanism is provided that allows to alternately pneumatically connect the front mouth, or the rear mouth, of which the surfaces cleaning device is provided, at opposite sides with respect to a brush having a horizontal axis. More precisely, the control mechanism provides a connection element slidingly mounted within an elongated aperture in order to move from a first position in which only the rear mouth sucks, or in a second position, in which only the front mouth sucks. The sliding of the connection element within the elongated aperture is operated by a cable attached to a solenoid that is electrically actuated.

A solution similar to the above is also described in U.S. Pat. No. 7,552,507.

SUMMARY OF THE INVENTION

It is therefore an object of the present invention to provide a machine for cleaning floors, in particular a scrubber machine, that is able to overcome the above described disadvantages of the scrubber machines of prior art.

It is in particular an object of the present invention to provide a scrubber machine that is able to effectively and accurately open, or close, the suction mouths of which is provided and that is, at the same time, easy to be manufactured.

These and other objects are achieved by the machine for cleaning surfaces comprising a main body and a handle portion configured to move the main body along a determined advancing direction, the above disclosed main body being equipped with:

- a cleaning brush configured to be positioned adjacent to said surface to be cleaned;
- a first squeegee element and a second squeegee element positioned at opposite sides of said cleaning brush along said advancing direction;
- a first suction mouth positioned at said first squeegee element and a second suction mouth positioned at said second squeegee element;
- a suction device connected to said first and to said second suction mouth by a suction circuit;

whose main characteristic is that the above disclosed suction circuit provides a deviation device configured to be alternately and selectively arranged in a first working configuration, in which said deviation device is arranged to pneumatically connect said first suction mouth to said suction device, and a pneumatically disconnect said second suction mouth from said suction device, and in a second working configuration, in which said deviation device is arranged to pneumatically disconnect said first suction mouth and said suction device, and to pneumatically connect said second suction mouth and said suction device, which is, furthermore, provided of an actuation device operatively connected to said deviation device and configured to cause said deviation device to move from said first working configuration to said second working configuration, or from said second working configuration to said first working configuration.

Advantageously, the actuation device can be, furthermore, operatively connected at least to said second squeegee element and is configured to position at least said second squeegee element in a position spaced from the surface, when the deviation device is arranged in the first working configuration, and in a position adjacent to the surface, when the deviation device is arranged in the second working configuration.

In particular, the actuation device is arranged to position the deviation device in a working configuration such that the suction device pneumatically communicates only with the suction mouth arranged downstream of the brush along the advancing direction of machine.

Further features of the invention and relative embodiments are defined in the dependent claims.

In particular, the first and the second squeegee element can be mounted, respectively, on a first and on a second support frame. More in particular, at least the second support frame can be operatively connected to the actuation device. In this case, the actuation device is configured to move the second support frame in the first working configuration in order to move the same away from the surface to be cleaned, in such a way to move the second squeegee element away from the surface same. In the second working configuration, instead, the actuation device is arranged to move the second support frame in order to move the same towards the surface to be cleaned, in such a way to position the second squeegee element adjacent to the surface.

In a further embodiment of the invention, also the first support frame can be operatively connected to the actuation device. In this case, the actuation device is configured to move both the first and the second support frame. More precisely, in the first working configuration, the actuation device is arranged to move the first support frame towards the surface to be cleaned, in such a way to position the first squeegee element adjacent to the surface to be cleaned, and, instead, to move the second support frame away from the surface to be cleaned, in such a way to move the second squeegee element away from the surface. In the second working configuration, instead, the actuation device is arranged to move the first support frame and, therefore, the first squeegee element, away from the surface to be cleaned, and to move the second support frame towards the surface to be cleaned, in such a way to position the second squeegee element adjacent to the surface.

Advantageously, the deviation device provides a hollow body having a first and a second inlet aperture respectively connected to the first and to the second suction mouth by a first and a second suction duct, and an outlet aperture connected to the suction device by an outlet duct. In particular, the hollow body is arranged to house an obturator member configured to be positioned, alternately, in a first working position, in which opens the first inlet aperture and closes the second inlet aperture, and in a second working position, in which closes the first inlet aperture and opens the second inlet aperture.

Advantageously, the obturator member comprises a supporting portion rotatably mounted about said rotational axis and provides:

- a first closing portion positioned at a first predetermined position of said supporting portion, said first closing portion being arranged to close said first inlet aperture in said second working position;
- a second closing portion positioned at a second predetermined position of said supporting portion, said second closing portion being arranged to close said second inlet aperture in said first working position.

According to another aspect of the invention, a machine for cleaning surfaces comprises a main body and a handle portion configured to move the main body along a determined advancing direction, the above disclosed main body being equipped with:

- a cleaning brush configured to be positioned adjacent to said surface to be cleaned;
- a first squeegee element and a second squeegee element positioned at opposite sides of said cleaning brush along said advancing direction;
- a first suction mouth positioned at said first squeegee element and a second suction mouth positioned at said second squeegee element;
- a suction device connected to said first and to said second suction mouth by a suction circuit;
- an actuation device operatively connected to at least said first squeegee element and configured to position at least said first squeegee element in a position spaced from said surface, when said cleaning machine is moved backward, and in a position adjacent to said surface, when said cleaning machine is moved forward, said actuation device being operated by a control portion;
- an additional actuation device configured to position at least said first squeegee element between a position spaced from said surface to be cleaned and a position adjacent to said surface to be cleaned;
- a blocking/unblocking device configured to move from a blocking configuration, in which is arranged to impede said positioning at least of said first squeegee element between said spaced position and said adjacent position by said additional actuation device, and an unblocking configuration, in which is not arranged to impede said positioning at least of said first squeegee element between said spaced position and said adjacent position by said additional actuation device.

In particular, the above disclosed suction circuit can provide a deviation device configured to be alternately and selectively arranged in a first working configuration, in which is arranged to pneumatically connect the first suction mouth to the suction device, and to pneumatically disconnect the second suction mouth from the suction device, and in a second working configuration, in which the deviation device is arranged to pneumatically disconnect the first suction mouth and the suction device, and to pneumatically connect the second suction mouth and the suction device. More in particular, a actuation device can be, furthermore, provided operatively connected to the deviation device and configured to cause the deviation device to move from the first working configuration to the second working configuration, or from the second working configuration to the first working configuration.

BRIEF DESCRIPTION OF THE DRAWINGS

The invention will now be shown with the following description of its exemplary embodiments, exemplifying but not limitative, with reference to the attached drawings in which:

FIG. 2 diagrammatically shows the machine of FIG. 1 in a side elevational view with a part removed in order to show a possible embodiment of the deviation device of which the same is provided, in a first working configuration;

FIG. 3 diagrammatically shows an enlargement of the deviation device of FIG. 2;

FIG. 12 shows another embodiment of the machine for cleaning surfaces, according to the invention;

FIGS. 13 and 14 show in detail some possible components of the machine of FIG. 12;

FIG. 16 diagrammatically shows a perspective side elevational view of still another alternative embodiment of machine of FIG. 1;

FIG. 17 shows a section according to the arrows XVII-XVII of the machine of FIG. 16;

FIG. 18 shows an enlargement of machine of FIG. 17 in order to highlight some technical characteristics;

DETAILED DESCRIPTION OF SOME EXEMPLARY EMBODIMENTS OF THE INVENTION

Figure 1:
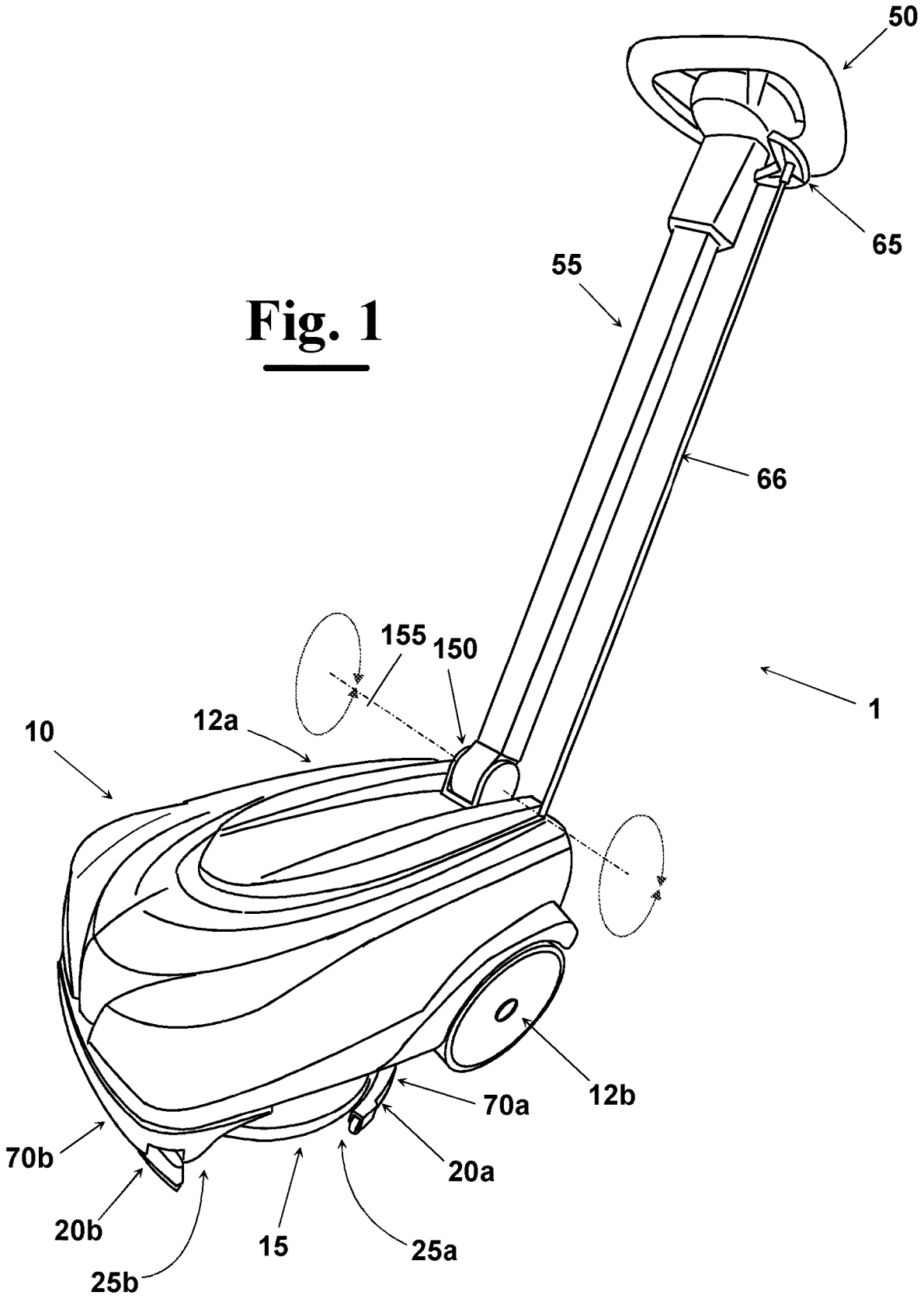
FIG. 1 diagrammatically shows a perspective side elevational view of a possible embodiment of the cleaning machine, according to the invention.

As diagrammatically shown in FIG. 1, a machine 1 for cleaning surfaces 100, in particular a scrubber machine for floors, according to the invention, comprises a main body 10 and a handle portion 50, which is grasped, in use, by a user to move and steer the main body 10 along the surface to be cleaned. In particular, the handle portion 50 can be provided at an end of a maneuvering bar 55 that is rotatably connected, at the opposite end, to the main body 10 by means of a joint 150, which allows to rotate the same about a rotational axis 155. The main body 10 can provide at least a couple of wheels 12*a* and 12*b*, which allow to move the same along an advancing direction on the surface 100 to be cleaned. The main body 10 is, preferably, equipped with a cleaning brush 15, in particular rotatably mounted about a rotational axis, for example a vertical rotational axis 115, configured to be positioned, in use, adjacent to surface 100 to be cleaned. The main body 10 is, furthermore, equipped with a first squeegee element 20*a*, or first cleaning blade, and with a second squeegee element 20*b*, or second cleaning blade, positioned at opposite sides with respect to cleaning brush 15 along the advancing direction along which machine 1 is moved during the cleaning operation. In addition to the above, the main body 10 of machine 1 provides a first suction mouth 25*a* positioned at, or near to, the first squeegee element 20*a*, and a second suction mouth 25*b*, positioned at, or near to, the second squeegee element 20*b*. More in particular, the first and the second suction mouth 25*a* and 25*b* can be respectively provided between the squeegee element 20*a* and the squeegee element 20*b* and the brush 15. The main body 10 provides, furthermore, a suction device 30 connected to the first and to the second suction mouth 25*a*, and 25*b*, by a suction circuit 35. More in detail, the suction device 30 is able to generate a predetermined vacuum level, in such a way to suck, in use, the dirt present on the surface 100 by the first, or the second, suction mouth 25*a*, or 25*b*. More in particular, by the first, or the second, suction mouth 25*a*, or 25*b* the washing fluid and the dirt present on surface 100 can be sucked up. The main body 10 can also provide a dirt collection container, not shown in the figures for reasons of simplicity, that is pneumatically connected to suction device 30.

According to the present invention, machine 1 provides, furthermore, a deviation device, or valve element, 40 for deviating the sucked flow, configured to pneumatically connect, alternately and selectively, the first, or the second, suction mouth 25*a*, and 25*b*, to the suction device 30. More precisely, the deviation device 40 is configured to be positioned, alternately and selectively, in a first working configuration, in which is arranged to pneumatically connect the first suction mouth 25*a*, i.e. the one positioned downstream of brush 15 along the movement direction forward of machine 1, and the suction device 30, and to pneumatically disconnect, instead, the second suction mouth 25*b*, i.e. the one positioned upstream of brush 15 along the movement direction of machine 1 forward, the suction device 30, or in a second working configuration, in which the deviation device 40 is arranged, instead, to pneumatically disconnect the first suction mouth 25*a* and the suction device 30, and to pneumatically connect the second suction mouth 25*b* and the suction device 30. Furthermore, an actuation device 60 is provided operatively connected to the deviation device 40. More precisely, the actuation device 60 is configured to cause the deviation device 40 to move from the first to the second working configuration, or vice versa. In light of the above, the suction device 30 pneumatically communicates only with the suction mouth 25*a*, or 25*b*, positioned downstream of the brush 15 along the advancing direction of machine 1. In this way the cleaning action of surface 100 cleaned by machine 1 is optimized, in particular during the cleaning of zones that are difficult to reach with machine 1, for example located under a piece of furniture, such as tables, or seats, or any furniture present in the room.

Figure 8:
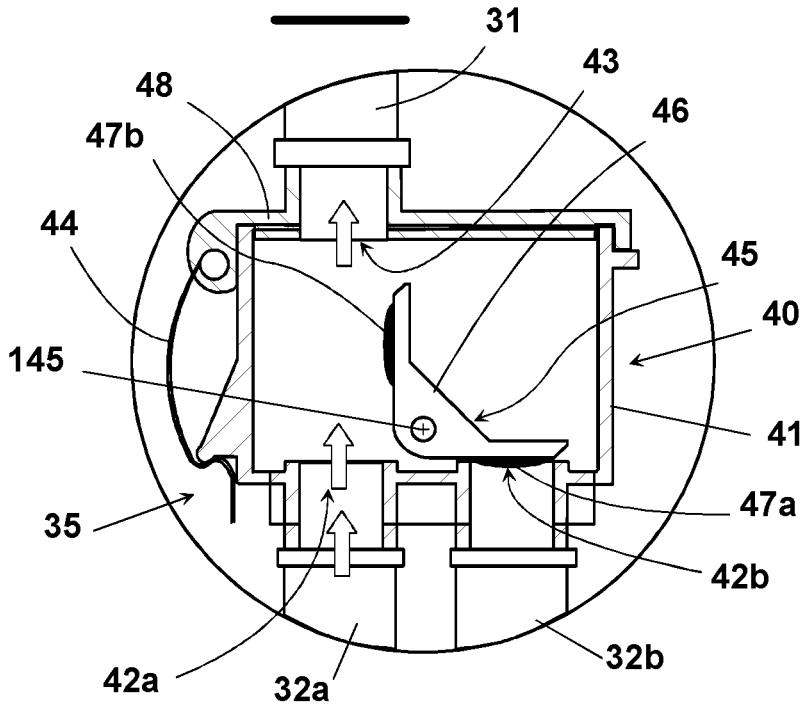
FIG. 8 diagrammatically shows an alternative embodiment of deviation device of FIG. 3 in the first working configuration.
Figure 9:
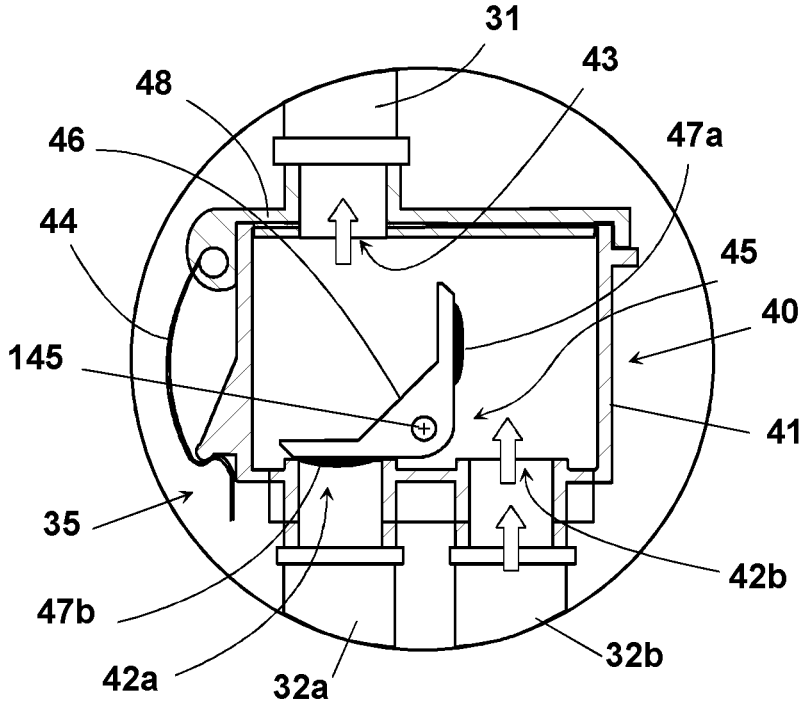
FIG. 9 diagrammatically shows an alternative embodiment of the deviation device of FIG. 6 in the second working configuration.

In a preferred embodiment of the invention, a return elastic element 63 is, furthermore, provided arranged to oppose the above disclosed movement of deviation device 40 from the first to the second working configuration, or vice versa. As shown in detail in the FIGS. 8 and 9, in an advantageous embodiment, the outlet aperture 43 can be substantially coaxially arranged with respect to the suction aperture 42*a*, i.e. the suction aperture of flow deviation device 40, pneumatically communicates with the rear suction mouth 25*a* of machine 1. This constructive solution allows, in particular, to avoid possible stagnations of dirt within the hollow body 41 because, as can be easily understood, for the majority of time, the machine 1 works in the first working configuration, i.e. is moved forward, and, therefore, with the first suction mouth 25*a* in communication with the suction device 30, whilst only in particular conditions is moved backward, which corresponds to the second working configuration, in which is the second suction mouth 25*b* to be connected with the suction device 30.

In an embodiment of the invention, the above disclosed actuation device 60 is, furthermore, operatively connected to at least a squeegee element, preferably at least to the second squeegee element 20*b*. More in particular, the actuation device 60 can be configured in such a way that, in the first working configuration is arranged to move the second squeegee element 20*b* in order to move the same away from surface 100. Instead, in the second working configuration, the actuation device 60 is arranged to move the second squeegee element 20*b* in order to arrange the same adjacent to the surface 100 to be cleaned.

Figure 10A:
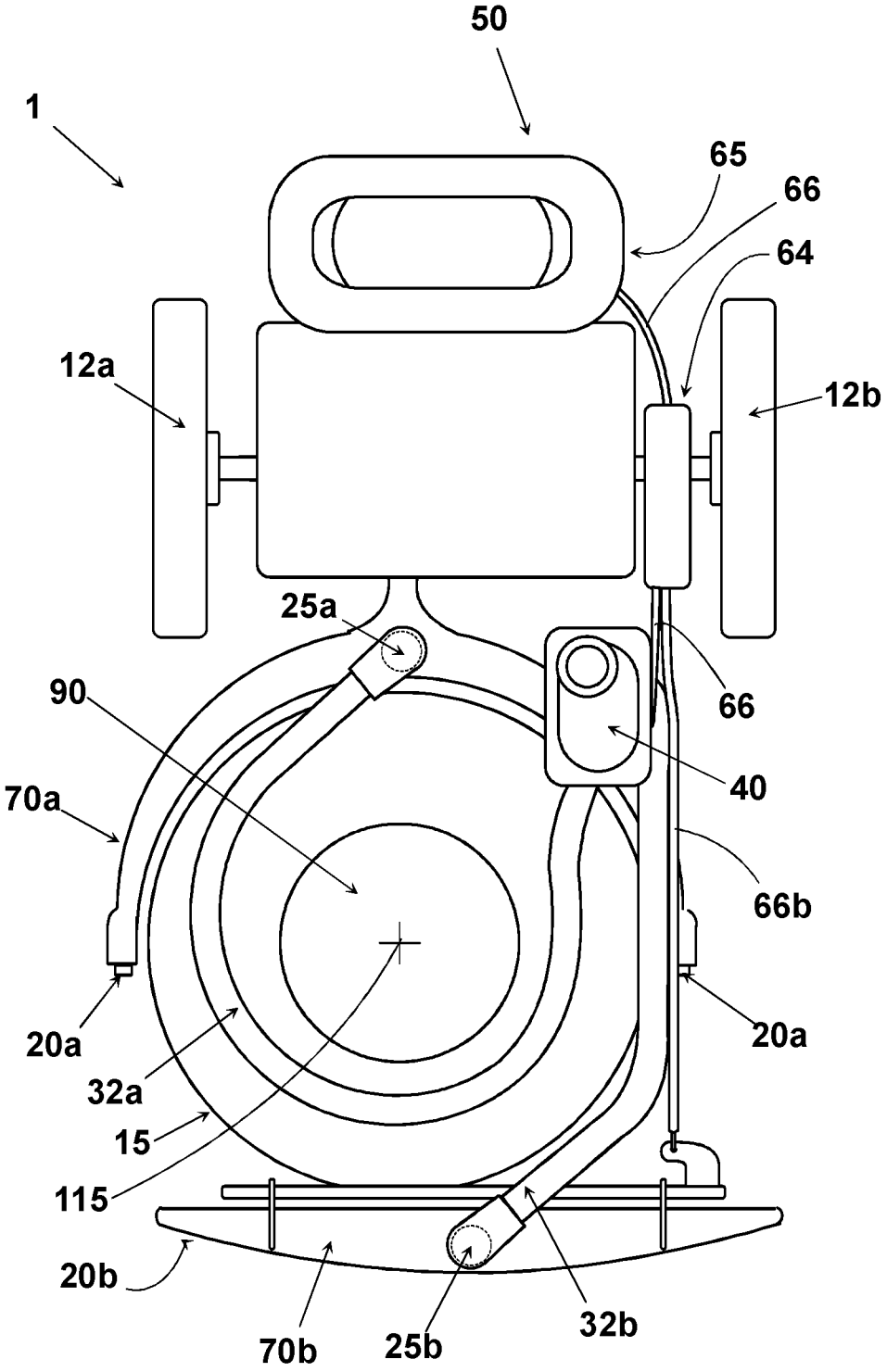
FIG. 10A diagrammatically shows a plan view of a possible alternative embodiment of the machine of FIG. 1.

In an alternative embodiment, the first and the second squeegee element 20*a* and 20*b* are respectively mounted on a first and a second support frame 70*a* and 70*b*. In particular, at least one support frame 70*a*, or 70*b*, preferably at least the second support frame 70*b*, is provided operatively connected to the actuation device 60, for example by an actuation cable 66*b*. In particular, as shown in the example of FIG. 10A, the actuation cable 66*b* of support frame 70*b* of squeegee element 20*b*, and in case, the cable 66, which actuates the flow deviation device 40, can be operatively connected by a transmission device 64 configured in such a way to actuate both of them simultaneously.

Figure 10B:
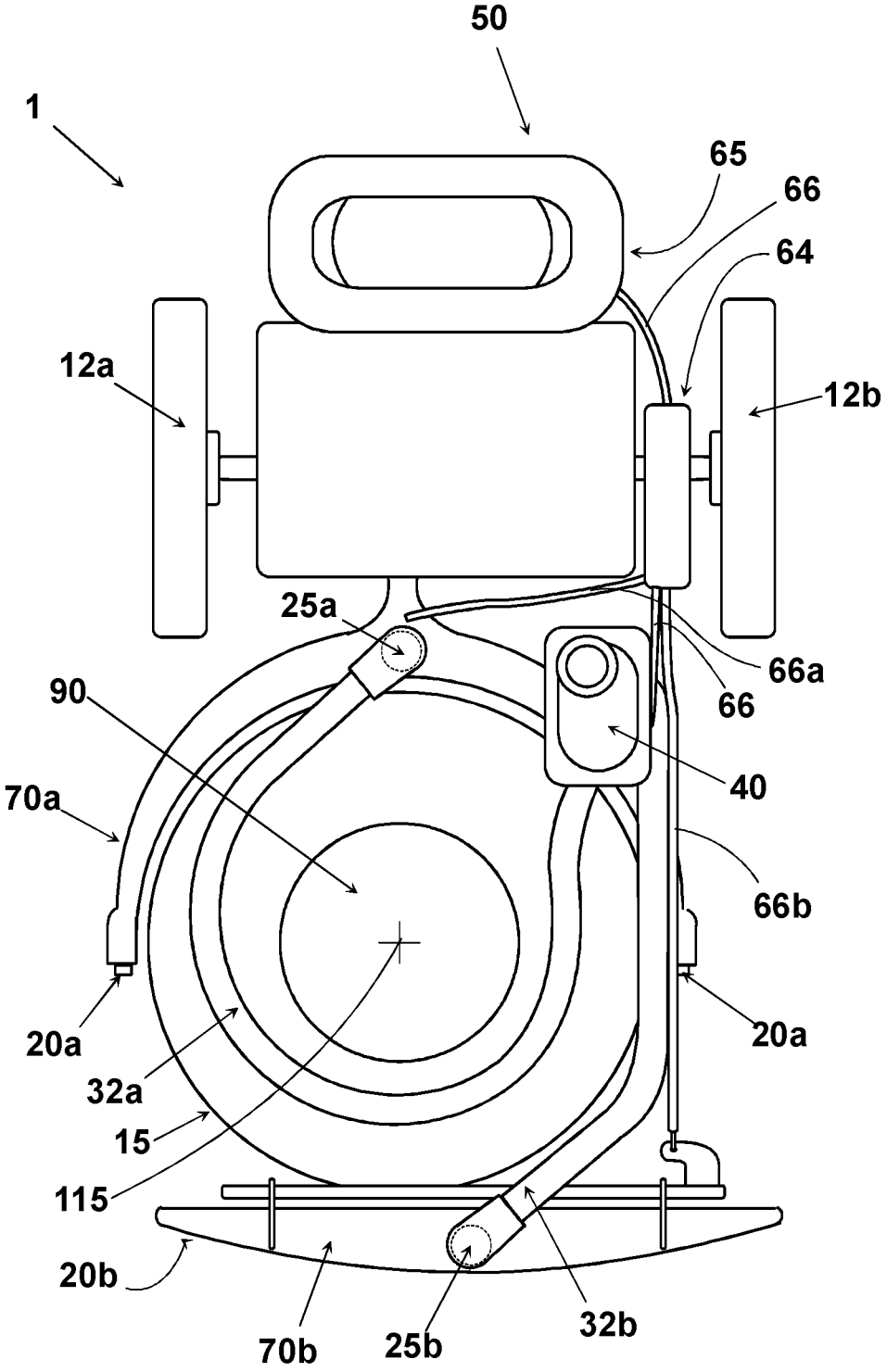
FIG. 10B diagrammatically shows a plan view of a further possible alternative embodiment of the machine of FIG. 1.

In a further alternative embodiment of the invention that is diagrammatically shown in FIG. 10B, also the first squeegee element 20*a* is provided operatively connected to the actuation device 60. In this case, the actuation device 60 is configured in such a way that, in the first working configuration, it positions the first squeegee element 20*a* adjacent to the surface 100 to be cleaned and move the second squeegee element 20*b* away from the surface 100 same. In the second working configuration, instead, the actuation device 60 is arranged to position the second squeegee element 20*b* adjacent to the surface 100 to be cleaned, and to move the first squeegee element 20*a* away from the surface 100. For example, the actuation device 60 can be operatively connected to the first and to the second squeegee element 20*a* and 20*b*, or to the respective support frame 70*a* and 70*b*, by a respective actuation cable 66*a* and 66*b*. In this case, the transmission device 64 can be configured in such a way that, when a cable, for example the cable 66*a* of the first support frame 70*a*, is actuated in order to move the squeegee element 20*a* away from the surface 100 to be cleaned, the movement of the other support frame is simultaneously caused, for example of the second support frame 70*b*, in order to move the same towards the surface 100 same, or vice versa.

Figures 5, 6:
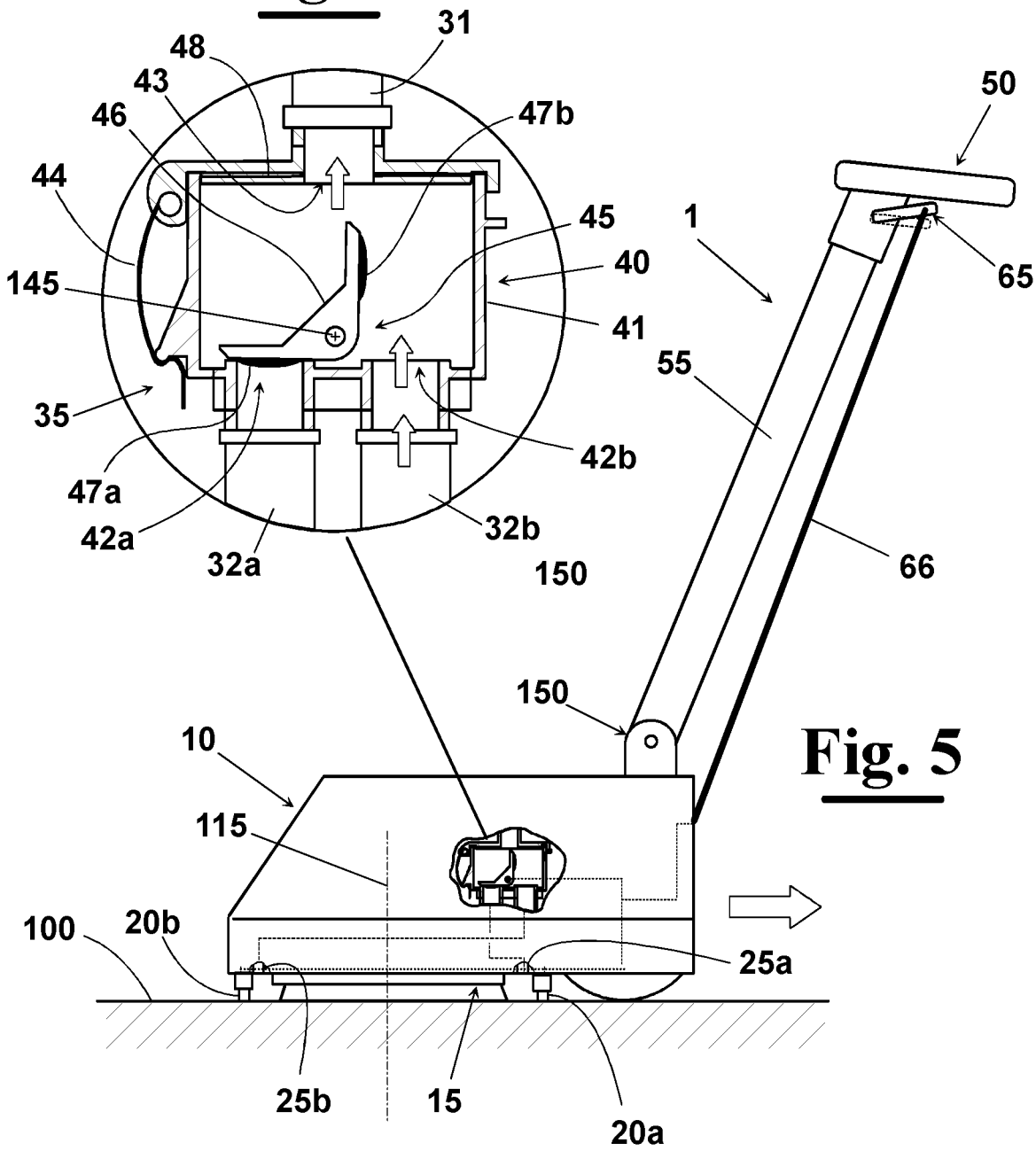
FIG. 5 diagrammatically shows the machine of FIG. 1 in a side elevational view, with a part removed in order to show the deviation device of FIG. 2 in a second working configuration.
FIG. 6 shows an enlargement of the deviation device of FIG. 5.

As shown in detail in the FIGS. 3 and 6, the deviation device 40 provides a hollow body 41 having a first and a second inlet aperture 42*a* and 42*b*, in the example shown in the figures provided at the same wall. The inlet apertures 42*a* and 42*b* are respectively connected to the first and to the second suction mouth 25*a* and 25*b*, by a first and a second suction duct 32*a* and 32*b*. The hollow body 41 provides, furthermore, an outlet aperture 43, for example made at the side opposite to the inlet apertures 42*a* and 42*b*, connected to the suction device 30 by an outlet duct 31. In the example of FIGS. 3 and 6, the hollow body 41 is associated to a lid 48. A retainer element 44 is, then, provided, for example made of elastic material, arranged to maintain the lid 48 in position with respect to the hollow body 41. In the case shown in the FIGS. 3 and 6, the outlet aperture 43 is made in the lid 48, but different solutions are however foreseen. The above described solution allows to provide a deviation device 40 that can be inspected, in fact the lid 48 can be easily removed from the hollow body 41 by skilled workers in order to carry out maintenance interventions, in particular to clean its components. Once the maintenance intervention is finished, the lid 48 can be easily positioned again above the hollow body 41. The possibility is, however, also provided that the deviation device 40 cannot be, instead, inspected.

Figure 7:
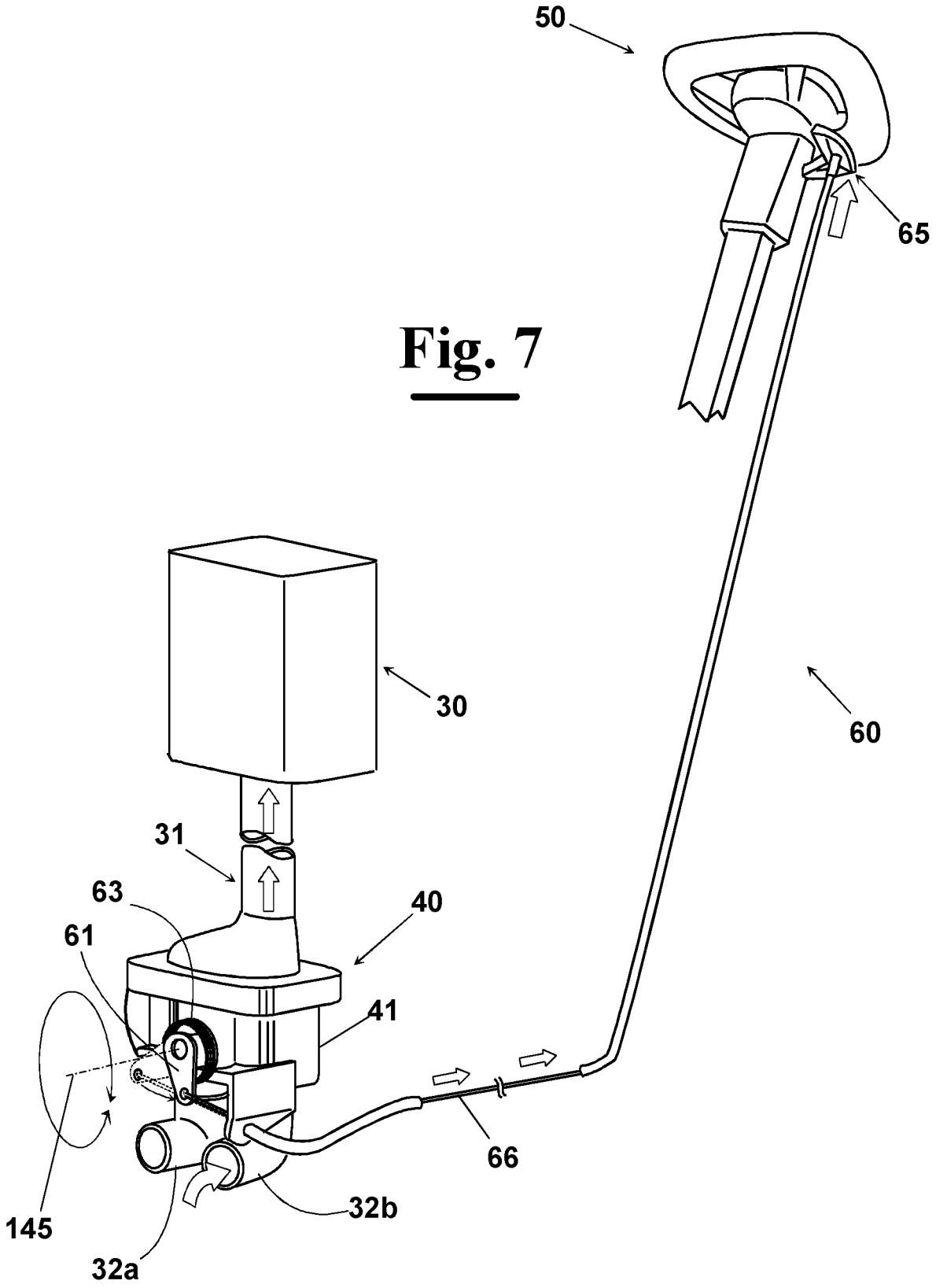
FIG. 7 diagrammatically shows a perspective side elevational view of the deviation device in the working configuration of FIG. 4.

Within the hollow body 41 an obturator member 45 is mounted configured to be positioned, alternately, in a first working position, in which is arranged to open the first inlet aperture 42*a*, and to close the second inlet aperture 42*b* (FIGS. 2-4), and a second working position in which is arranged to close the first inlet aperture 42*a* and to open the second inlet aperture 42*b* (FIGS. 5-7).

In the example shown in the FIGS. 2 to 7, the obturator member 45 is configured in such a way to move between the first and the second working position by rotating about a rotational axis 145. The skilled person in the art will have no difficulties to understand that the above disclosed movement from the first to the second position and vice versa, can be obtained by sliding, or a combination of movements, cases that are not shown in the figures for simplicity of illustration, without departing from the inventive concept of the invention.

As shown in detail in the FIGS. 3 and 6, the obturator member 45 comprises a supporting portion 46 rotatably mounted about the rotational axis 145. The supporting portion 46 provides, respectively, at a first and at a second predetermined position, a first and a second closing portion 47*a* and 47*b*. These can provide pneumatic sealing elements, for example made of rubber, that are respectively arranged to close the first inlet aperture 42*a*, and the second inlet aperture 42*b* of the hollow body 41, at the second and at the first working position. More in detail, the first and the second closing portion 47*a* and 47*b* are positioned on the supporting portion 46 at respective angular positions identifying a predetermined angle $\alpha$ corresponding to the angle of rotation about the rotational axis 145 to move from the first to the second working position. In the case shown in the figures, the supporting portion 46 is substantially "L-shaped" and, therefore, the above disclosed angle $\alpha$ is about 90°, but different solutions are, however, provided without modifying the inventive concept at the base of the present invention.

The actuation device 60 provides at least a control portion 65, advantageously a hand control portion, such as a control lever configured to be hand-operated by the user. The control portion 65 can be, in particular, positioned at, or in proximity, of the handle portion 50. As shown in the FIGS. 1 to 8, the control lever 65 can be operatively connected to the obturator member 45 only, or, as provided in an alternative embodiment, both to the obturator member 45 and at least to the second squeegee element 20*b*, by an actuation element, for example an actuation cable 66, in particular made of an inextensible material. For example, the control lever 65 can be engaged to the maneuvering bar 55 below the handle portion 50, and at a distance from this such that it can be actuated by the user without letting go the handle portion 50.

Figure 11:
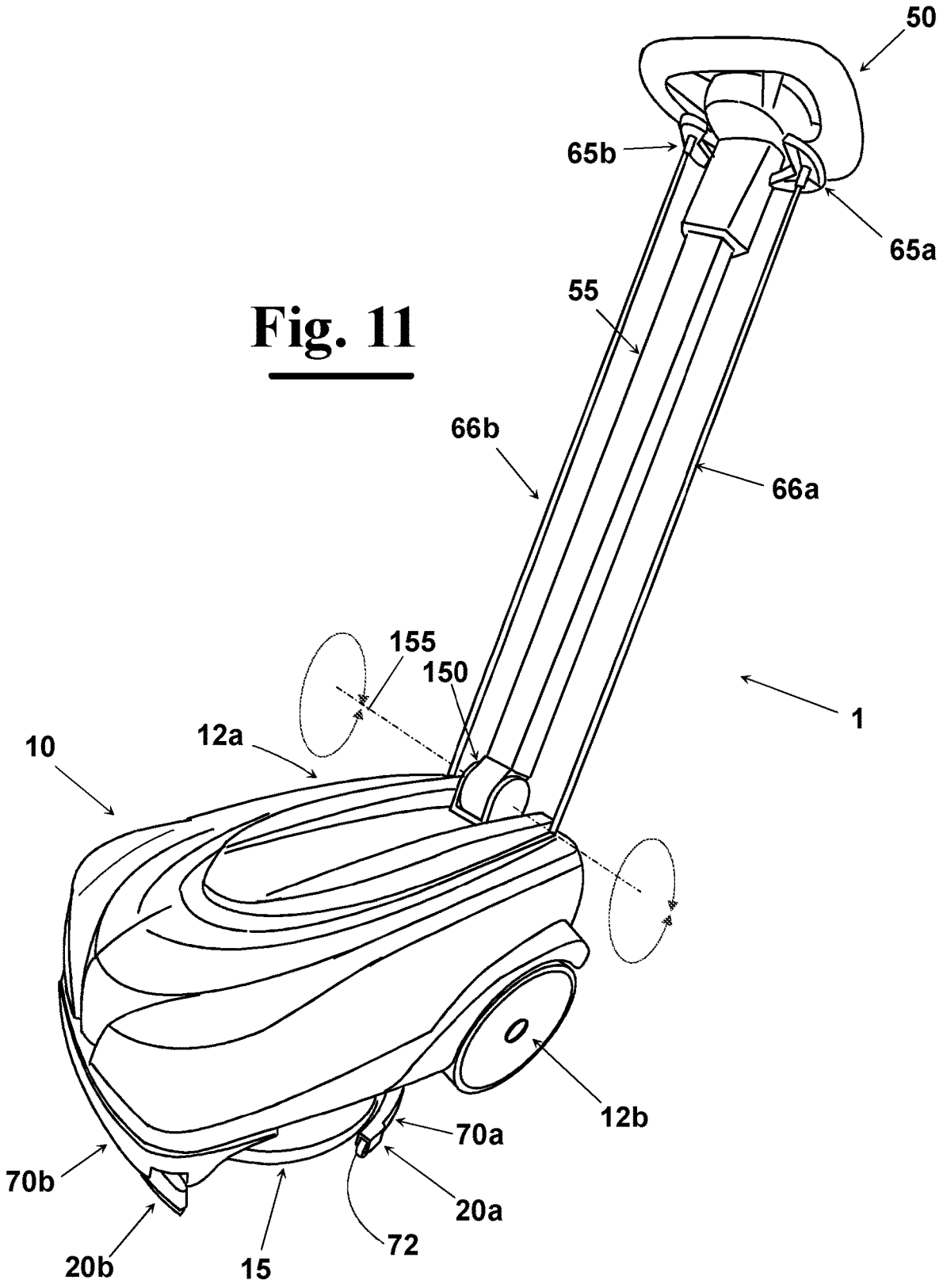
FIG. 11 shows a perspective side elevational view of an alternative embodiment of the machine of FIG. 1.

In another alternative embodiment provided that is diagrammatically shown in FIG. 11, the actuation device 60 provides a first and a second control portion 65*a* and 65*b*, for example positioned at opposite sides with respect to handle portion 50. More precisely the first control portion 65*a* can be operatively connected to the above disclosed obturator member 45 by a first cable 66*a*, whilst the second control portion 65*b* can be operatively connected to the support frame 70*b* on which is mounted at least the second squeegee element 20*b*.

Figure 4:
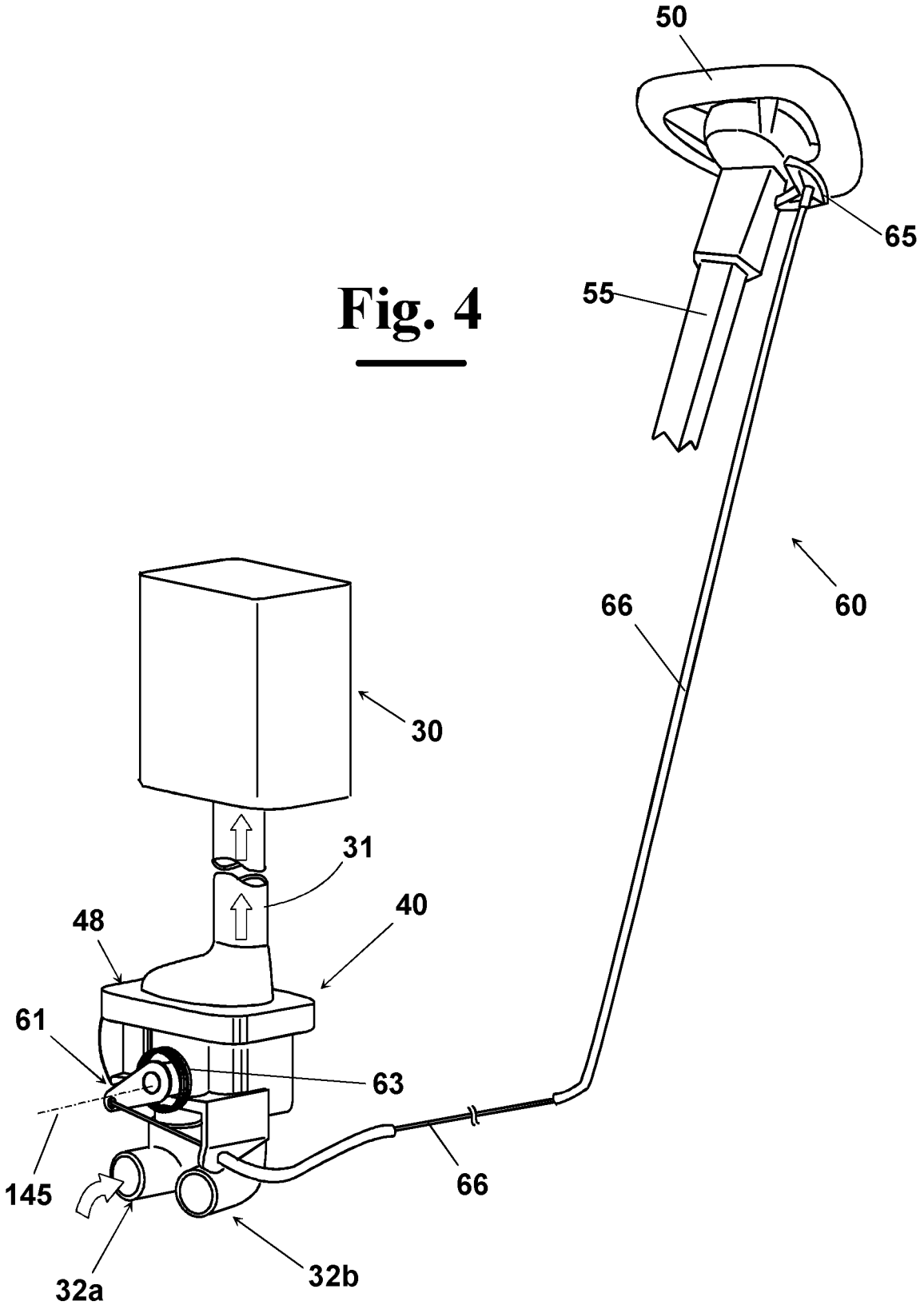
FIG. 4 diagrammatically shows a perspective side elevational view of the deviation device in the working configuration of FIG. 2.

In the example shown in detail in the FIGS. 4 and 7, the actuation device 60 provides a cam element 61 connected by an actuation cable 66 to the control lever 65, and integral to the supporting portion 46. More in detail, when the user wants to reverse the advancing movement of machine 1 with respect to the normal one, i.e. when he wants to move backward the machine 1, he/she acts on the control lever 65, in such a way to cause a translation of the actuation cable 66. This causes a rotation of the cam element 61 fixed to one end of the actuation cable 66 and, therefore, of the supporting portion 46, which is integral to it. More in particular, the rotation of the supporting portion 46 is such to bring the closing portion 47*a* in the closing position of the suction aperture 42*a* and, therefore, to isolate the suction mouth 25*a* from the suction device 30. At the same time, the rotation of the supporting portion 46 brings the closing portion 47*b* in an opening position of the suction aperture 42*b*, and therefore the suction mouth 25*b* is brought pneumatically communicates with the suction device 30. When, instead, the machine 1 is again moved forward, it is sufficient that the user stops his/her action on the control portion 65 in order to bring the deviation device 40 back in the previous working condition owing to the presence of a return elastic element 63 arranged to oppose the above disclosed movement of the deviation device 40 from the first to the second working configuration. In particular, a return spring 63 can be provided, for example a torsional spring, arranged around the rotational axis 145 of the supporting portion 46 and arranged to oppose the above mentioned rotation of cam element 61. Therefore, when the user let the control lever 65 go, the return spring 63 brings the cam element 61 back in the initial condition, in which the obturator 45 pneumatically connects the suction mouth 25*a* and the suction device 30, and pneumatically isolates, instead, the suction mouth 25*b* and the suction device 30 same.

In this way, it is possible, in a simple, but at the same time, extremely accurate way, to open the suction mouth 25*a*, or 25*b*, positioned downstream of the rotating brush 15 with respect to the movement direction of machine 1 and to close, instead, the suction mouth 25*b*, or 25*a*, positioned upstream.

In particular, the cleaning brush 15 can be operated by a motor group 90 configured to cause it to rotate about a rotational axis 115, advantageously a vertical rotational axis. More in particular, the motor group 90 can be configured to cause the cleaning brush 15 to rotate about the rotational axis 115, in a first sense of rotation, when the machine 1 works in the above mentioned first working configuration, and in a second sense of rotation opposite to the first, when, instead, the machine 1 works in the above mentioned second working configuration.

In the embodiment diagrammatically shown in the figures from 12 to 14, the machine 1 provides, furthermore, an additional actuation device 80 configured to move at least the first squeegee element 20*a* between a position adjacent to the surface 100 to be cleaned, and a position spaced from the surface 100 same. In particular, a blocking/unblocking device can be provided, not shown in the figures for simplicity, configured to move from a blocking configuration, in which is arranged to impede the above disclosed movement of at least the first squeegee element 20*a* between the position spaced and the position adjacent by the additional actuation device 80, and an unblocking configuration, in which is not arranged to impede the above disclosed movement of at least the first squeegee element 20*a* between the position spaced and the position adjacent by the actuation device 80. For example, the blocking/unblocking device can provide a blocking element, in particular a blocking pin, configured to engage a movable part of the actuation device 60 with a fixed part of the same.

In particular, an additional control portion 85 is provided configured to actuate the additional actuation device 80 by a user. More in particular, the additional control portion 85 can be operatively connected at least to the first squeegee element 20*a*, advantageously to the support frame 70*a* to which the same is integral, by an additional actuation element 86, for example an additional actuation cable 86. For example, as shown in detail in FIG. 12, the additional control portion 85 can be operatively connected at least to the first squeegee element 20*a*, advantageously the support frame 70*a* on which the same is mounted, by an additional actuation element 86, advantageously an actuation cable made of an inextensible material. In this way, when the user actuates the additional control portion 85 causes the movement, at least del first squeegee element 20*a*, between the position adjacent to the surface to be cleaned, or more in general to the plane identified by the wheels 12*a* and 12*b* of the machine 1, and the above disclosed position spaced from the surface same. In particular, the additional actuation element 66 can have an end fixed to the above mentioned additional control portion 85 and the opposite end fixed to a actuation portion 87. This can be connected to the support frame 70*a* by one, or two, connection arms 88*a* and 88*b* and configured in such a way to rotate about a rotational axis 90 in order to cause the raising or the lowering of the frame 70*a*, and therefore at least of the first squeegee element 20*a*.

Figure 15A:
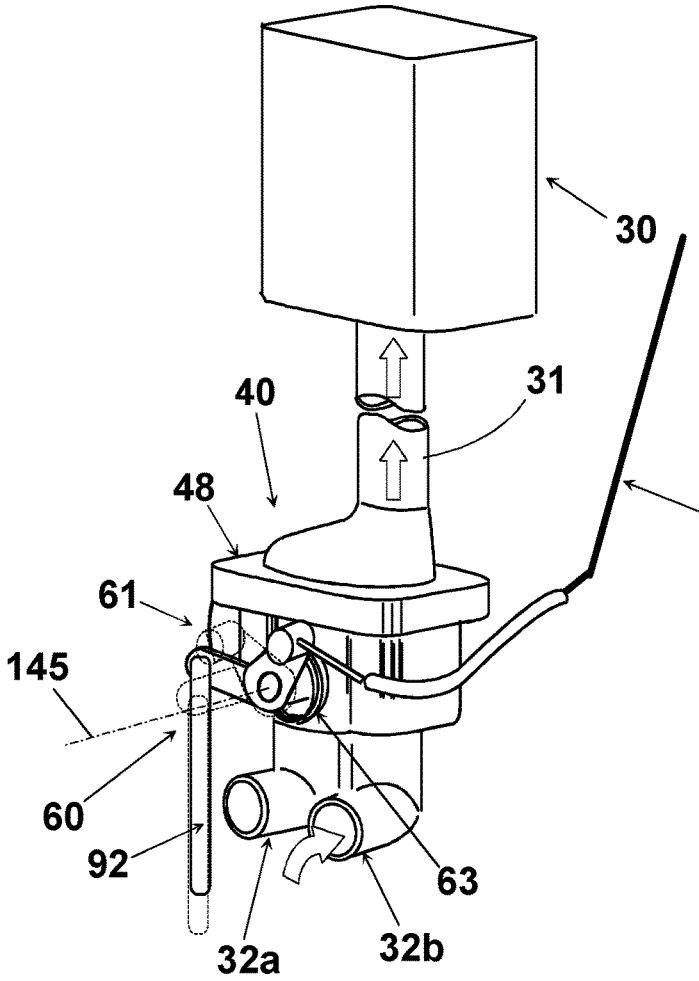
FIGS. 15A and 15B diagrammatically show, in two different working configurations, a possible embodiment of the actuation device alternative to those shown in FIGS. 4 and 7.
Figure 15B:
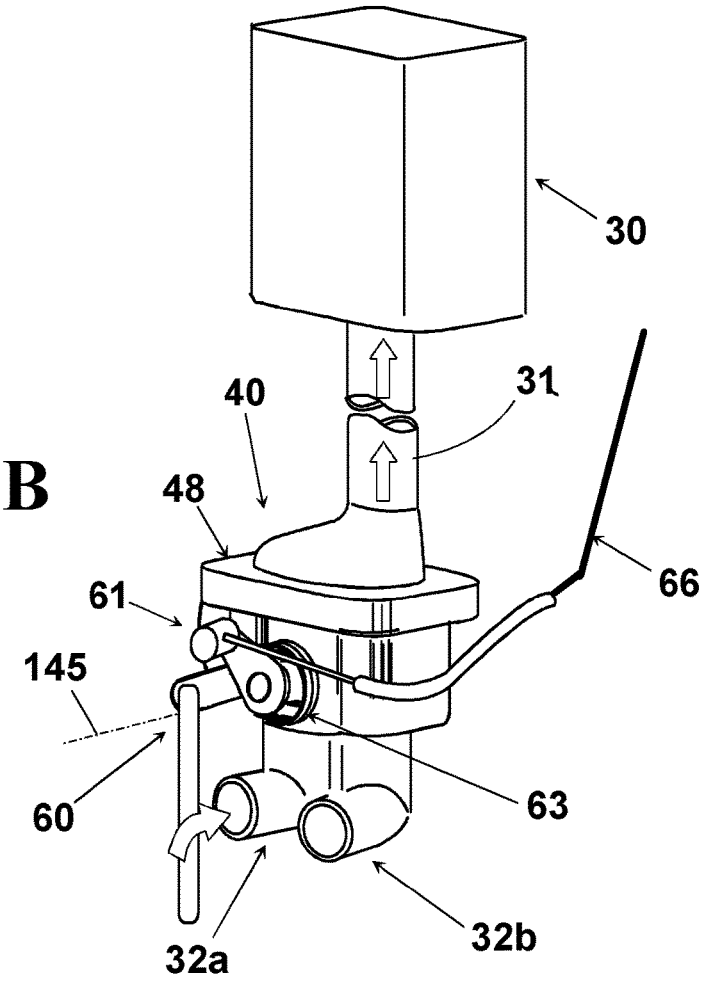

In the embodiment diagrammatically shown in the FIGS. 12 and 14, the actuation device 60 can comprise a first engagement portion 92 configured to move the support frame 70*a* of the first squeegee element 20*a* between the position adjacent to the surface 100 and the position spaced from the surface 100 same. In particular, the first engagement portion 92, for example hook-shaped, can be configured to engage the support frame 70*a*, in particular at a second engagement portion 22 of the same, advantageously curvilinear shaped. More in particular, the first engagement portion 92 and the second engagement portion 22 are configured in such a way that the second engagement portion 22 is free to move with respect to the first engagement portion 92, when the actuation device 60 is not actuated and the squeegee element 20*a* is adjacent to the surface 100. In this way, the first engagement portion 92 does not interfere with the rotation of frame 70*a* about the rotational axis 115 during the cleaning action of machine 1. When the actuation device 60 is actuated, instead, in particular by acting on the control portion 65, which actuates the deviation device 40, or on a dedicated control portion such the one of the embodiment of FIG. 11, the raising of the first engagement portion 92 and of the second engagement portion 22 engaged to the same is caused, and, therefore, at least of the first squeegee element 20*a*. The technical solution above described allows the first engagement portion 92 to lift the second engagement portion 22 independently from its position, that means from the spatial orientation, of the squeegee element 20*a* with respect to the main body 10. As diagrammatically shown in the FIGS. 15A and 15B the movement of the first engagement portion 92 can be obtained by an alternative embodiment of the cam element 61 shown in the FIGS. 4 and 7, to which it can be connected. In particular, the cam element 61 can be configured in such a way that, when it is desired to reverse the movement of machine 1 with respect to the normal motion, i.e. when it is desired to move backward the machine 1, the user acts on the control lever 65, or on each control lever 65*a* and 65*b*, connected to cam element 61 by an actuation cable 66, or 66, in order to cause the cam element 61 to rotate in a first sense of rotation, about a rotational axis 145. The rotation of cam element 61 in the first sense of rotation, beside of causing the above disclosed moto of the obturator member, causes also a translation of the first engagement portion 92 and, therefore, of the second engagement portion 22, which is engaged to the same, one towards the other. In this way, therefore, the squeegee element 20*a*, which is integral to the second engagement portion 22, is raised from the surface 100. Instead, when the machine 1 is moved forward again, it is sufficient that the user stops his/her action on the control portion 65 in order to cause, for example because an elastic element 63 is present arranged to oppose the above mentioned rotation of the cam element 61, a rotation of cam element 61 in a second sense of rotation opposite to the first sense of rotation, which brings the first engagement portion 92, and, therefore, the second engagement portion 22, back in the lowered position. In this way, the squeegee element 20*a* is positioned in a position adjacent to the surface 100 to be cleaned.

In particular, the additional actuation device 80 can be used for raising at least the first squeegee element 20*a*, when the machine 1 is not working, in particular when it is parked in a parking area after its use, but also during the transfer of machine 1 same from a place to another one, in such a way to avoid that the squeegee element 20*a* can warp, or however, wear out, because of coming into contact with surfaces different from the one to be cleaned. Instead, the actuation device 60 can be actuated in order to temporary raised the first squeegee element 20*a* in determined working conditions. In particular, the first squeegee element 20*a* can be temporary raised by the user in order to avoid that when the direction of movement of machine 1 is reversed from the forward movement to the backward movement and again to the forward movement, for example for cleaning the surface under a furniture, or a table, or a seat, in particular when the operation is carried out in proximity of, or at, a curve, the first squeegee element 20*a* adjacent to the surface 100 can leave a "trail", or "slime", of washing liquid on the surface.

In addition to the above, the machine 1, according to the invention, will provide a device for delivering a determined quantity of washing liquid on the brush 15, not shown in the figures for simplicity, but, however, of known type in the technical field of reference.

According to another aspect of the invention, as diagrammatically shown in the FIGS. 16 to 20, the main body 10 can comprise a base frame 11, in particular the part of the main body 10 rotatably connected to the maneuvering bar 55, and at least a removable portion 13, which is removably engaged with the base frame 11. The removable portion 13 can form a covering for the components of machine 1 and, therefore, a quick removal of the same can speed up and simplify to reach the different components in order to carry out the ordinary, or extraordinary, maintenance interventions, on machine 1. More in particular, the removable portion 13 can be configured in such a way to form at least a containment body. For example, the removable portion 13 can form a first container for the washing liquid that is delivered during the cleaning action, and a second container in which the dirty liquid is collected before being discharged. In the example shown in the FIGS. 16 to 20, a first and a second removable portion 13*a* and 13*b* are provided. Advantageously, the first and the second removable portion 13*a* and 13*b* can provide respective surfaces configured to carry out a shape coupling, for example a snap-fit joint. The second removable portion 13*b* is, then, engaged, as described in the following, to the base frame 11. As shown in detail in the FIGS. 16 to 20, the base frame 11 and the removable portion 13, in the example shown in the FIGS. 16 to 19, the second removable portion 13*b*, can provide, respectively, a first and a second engagement element 18 and 17 configured to move from a disengagement position (FIGS. 19 and 20), in which is possible to remove the removable portion, for example the second removable portion 13*b*, from the base frame 11, and an engagement position, in which the above disclosed removal is, instead, impeded. For example, the removal of the removable portion 13, or of each removable portion 13*a*, 13*b*, from the base frame 11, can be carried out by lifting the, or each, removable portion 13*a*, 13*b*, with respect to the base frame 11.

Figure 19:
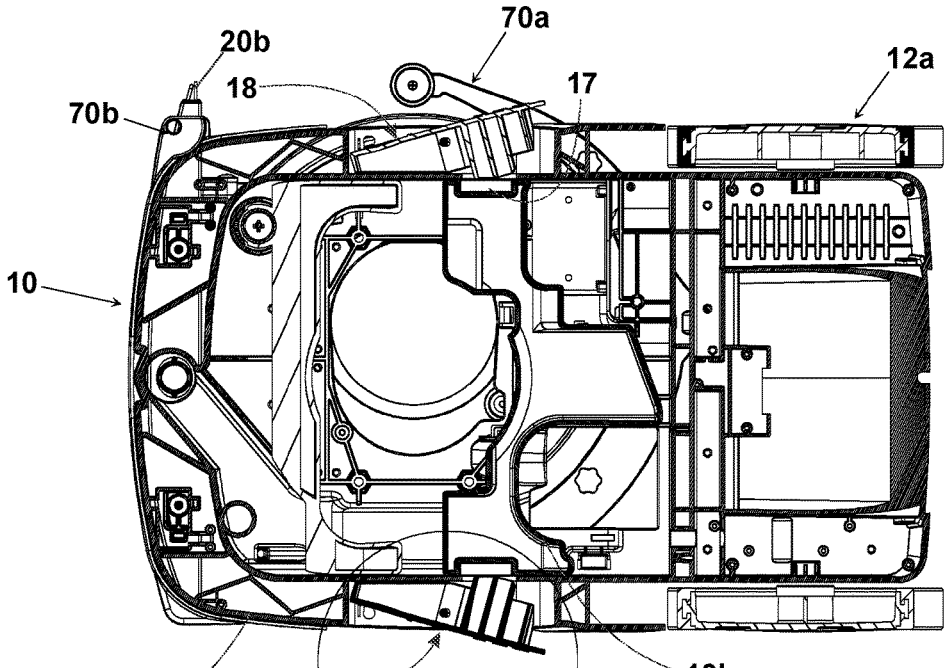
FIG. 19 shows a section similar to the one of FIG. 18 but in another working position of the engagement elements.
Figure 20:
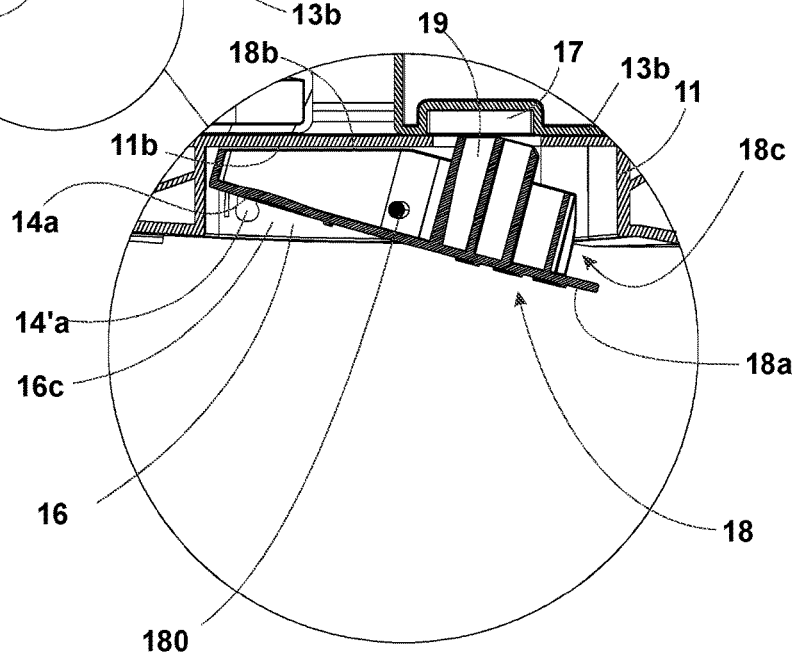
FIG. 20 shows an enlargement of machine of FIG. 19 in order to highlight some technical characteristics.

Advantageously, the first engagement element 18 can move between an engagement position, in which engages the second engagement element 17 of the removable portion 13*b*, and impedes it to be removed (FIGS. 17 and 18), and a disengagement position, in which the first engagement element 18 does not engage the second engagement element 17 and, therefore, allows the removable portion 13*b* to be removed from the base frame 11 (FIGS. 19 and 20). In the example shown in the FIGS. 17 to 20, the first engagement element 18 provides a protruding portion 19 configured in such a way to face towards the base frame 11. In this case, in the engagement position, the protruding portion 19 is arranged to engage a recess 17 provided on the lateral surface of the removable portion 13*b*. In the disengagement position, instead, the protruding portion 19 is positioned outside of the above mentioned recess 17.

In the embodiment shown in the FIGS. 17 to 20, the first engagement element 18 is provided rotatably engaged to the base frame 11 at a housing 16. Therefore, the movement of the first engagement element 18 from the engagement position to the disengagement position can be carried out by causing the same to rotate about a rotational axis 180, advantageously a vertical rotational axis, in a first sense of rotation. Instead, the movement of the first engagement element 18 from the disengagement position to the engagement position is carried out by causing the first engagement element 18 to rotate about the rotational axis 180 in a second sense of rotation opposite to the first one. The first engagement element 18, at a face of the same, in the case diagrammatically shown in figure the lower face 18*c*, can provide a guide element that cannot be seen in the figure, for example a guide pin sliding within a guide hole 14*a* provided on a surface 16*c* facing, in use, towards surface 18*c* of the first engagement element 18, in such a way to guide the movement, for example the rotation, of the first engagement element 18 during the movement from the engagement position to the disengagement position, and vice versa. In particular, the guide hole 14*a* can provide at least an enlarged portion 14*a*', in particular, at the limit position of the engagement position, and the above mentioned guide pin can be an elastic portion arranged to engage the above mentioned enlarged portion 14*a*'. In this way, in order to move the first engagement element 18 away from the engagement position it is necessary to win the elastic force exerted by the elastic portion of the guide pin, thus assuring a high stability of the engagement between the first and the second engagement element 18 and 17.

Preferably, the first engagement element 18 has a first surface 18*a* that, at the engagement position, (see FIG. 18) is arranged substantially "flush" with the external surface 11*a* of base frame 11. Furthermore, the first engagement element 18 can, furthermore, provide a second surface 18*b*, inclined of a predetermined angle with respect to the first surface 18*a*, is arranged to abut against a respective internal surface 11*b* of housing 16, at the disengagement position, which therefore defines the maximum amplitude of rotation for the first engagement element 18 (see FIG. 20). The machine 1 above described with reference to the FIGS. 16 to 20, can be equipped with any combination of the technical characteristics above described with reference to the FIGS. 1 to 15B.

Figure 21A:
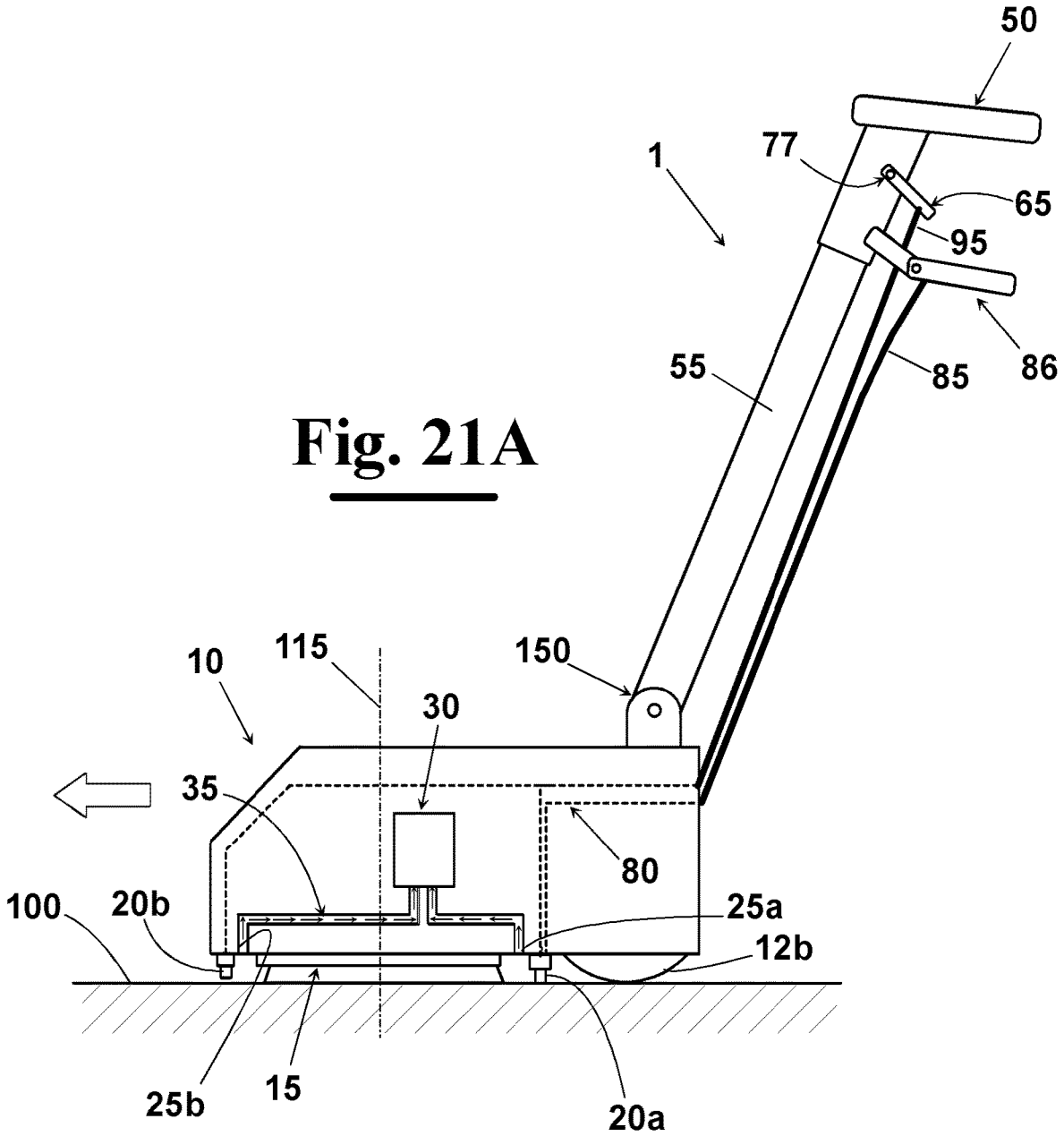
FIGS. 21A and 21B diagrammatically show in two different working configurations a machine for cleaning surfaces according to another aspect of the invention.
Figure 21B:
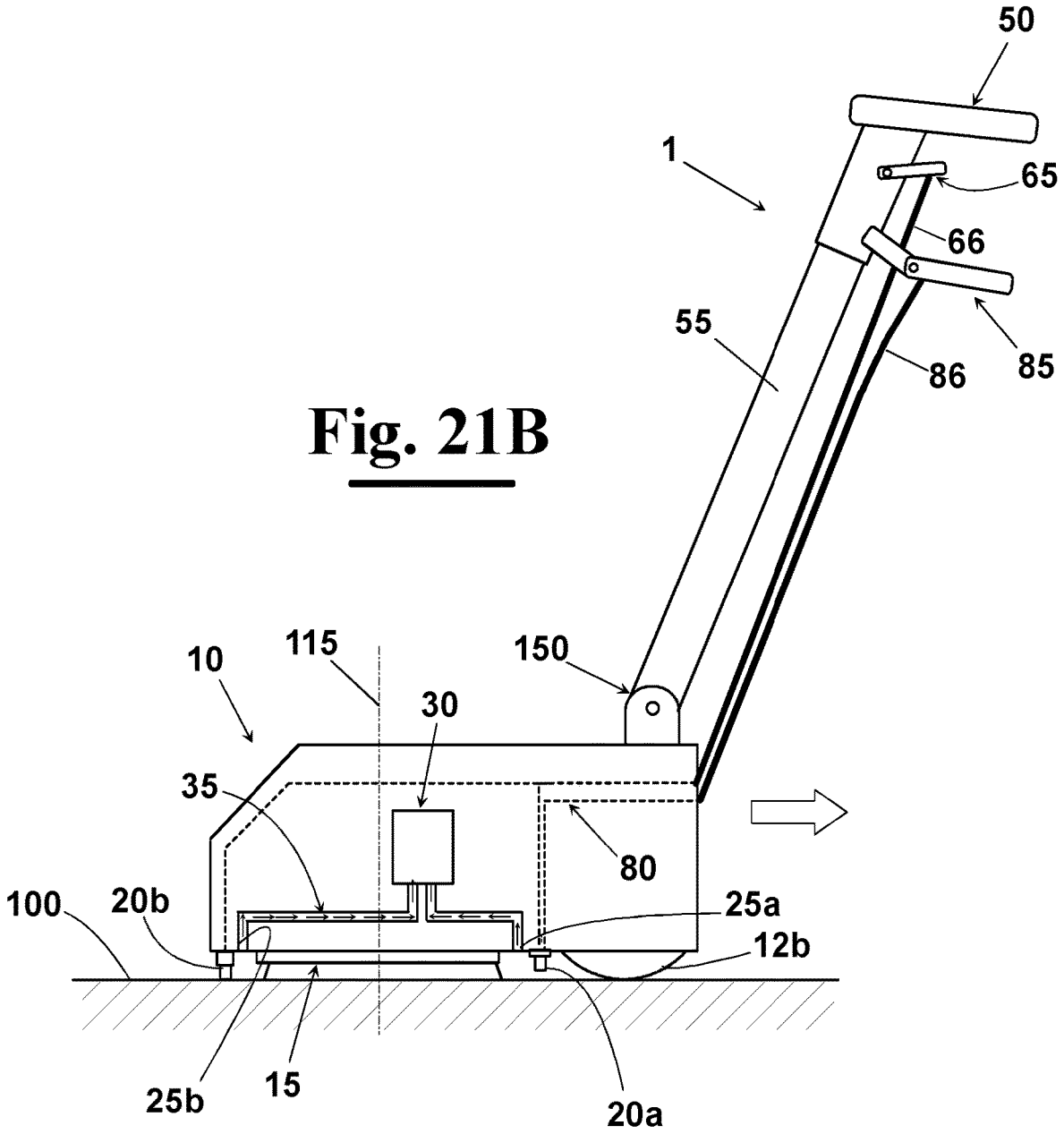

According to a further aspect of the invention, diagrammatically shown in the FIGS. 21A and 21B, the machine 1 can comprise the components above described with reference to the embodiments shown in the FIGS. 1 to 11, except the above disclosed deviation device 40. In this case, therefore, the suction device 30 is directly connected to the first and to the second suction mouth 25*a* and 25*b*. In particular, the machine 1 can provide one of the embodiment of the actuation device 60 above described with reference to the FIGS. 1 to 15B, and an additional actuation device 80. More in particular, the actuation device 60, as above described, can be configured to displace at least the first squeegee element 20*a* between a position adjacent to the surface to be cleaned and a position spaced from the same, during the working of machine 1, i.e. during its movement on the surface 100. More in detail, as shown in FIG. 21B the squeegee element 20A can be moved from position adjacent to the surface 100 of FIG. 21A, in which it works when the machine 1 is moved forward, to the position spaced from the same, when the machine 1 is moved backward. This operation can be carried out, as above described, by a single actuation element 66, which actuates also the movement of the second squeegee element 20*b* between a position adjacent and a position spaced from the surface to be cleaned, or by a dedicated control portion (FIG. 11). Furthermore, an additional actuation device 80 can be provided that is actuated by an additional control portion 85 in order to permanently raise, or lower, at least the squeegee element 20*a*, i.e. when the machine 1 is not working, in order to avoid that the same can wear out because of becoming into contact with a surface.

It is, however, also provided that the machine 1 above described and shown in the FIGS. 21A and 21B can also provide the above disclosed deviation device 40, and in case to provide any one of the combinations of the technical characteristics above described with reference to the FIGS. 1 to 20.

The foregoing description exemplary embodiments of the invention will so fully reveal the invention according to the conceptual point of view, so that others, by applying current knowledge, will be able to modify and/or adapt for various applications such embodiment without further research and without parting from the invention, and, accordingly, it is therefore to be understood that such adaptations and modifications will have to be considered as equivalent to the specific embodiments. The means and the materials to realize the different functions described herein could have a different nature without, for this reason, departing from the field of the invention. It is to be understood that the phraseology or terminology that is employed herein is for the purpose of description and not of limitation.

The invention claimed is:

1. Machine for cleaning surfaces comprising a main body and a handle portion configured to move said main body along a determined advancing direction, said main body being equipped with:

a cleaning brush configured to be positioned adjacent to said surface to be cleaned;

a first squeegee element and a second squeegee element positioned at opposite sides of said cleaning brush with respect to said advancing direction;

a first suction mouth positioned at said first squeegee element and a second suction mouth positioned at said second squeegee element;

a suction device connected to said first and to said second suction mouth by a suction circuit, wherein:

said suction circuit comprises a deviation device configured to be positioned alternately and selectively in a first working configuration, in which said deviation device is arranged to pneumatically connect said first suction mouth to said suction device, and to pneumatically disconnect said second suction mouth from said suction device, and in a second working configuration, in which said deviation device is arranged to pneumatically disconnect said first suction mouth from said suction device, and to pneumatically connect said second suction mouth to said suction device in that an actuation device is provided operatively connected to said deviation device and configured to cause said deviation device to move from said first working configuration to said second working configuration, or from said second working configuration to said first working configuration, and said actuation device operatively connected at least to said second squeegee element, and is configured to arrange at least said second squeegee element in a position spaced from said surface when said deviation device is arranged in said first working configuration, and in a position adjacent to said surface, when said deviation device is arranged in said second working configuration.

2. The machine for cleaning surfaces according to claim 1, wherein an elastic element is provided configured to oppose the movement of said deviation device from said first to said second working configuration, or from said second to said first working configuration.

3. The machine for cleaning surfaces according to claim 1, wherein said deviation device provides a hollow body having a first and a second inlet aperture respectively connected to said first and to said second suction mouth by a first and a second suction duct, and an outlet aperture connected to said suction device by an outlet duct, said hollow body being arranged to house an obturator member configured to be positioned, alternately, in a first working position, in which is arranged to open said first inlet aperture and to close said second inlet aperture, and in a second working position, in which is arranged to close said first inlet aperture and to open said second inlet aperture.

4. The machine for cleaning surfaces according to claim 3, wherein said obturator member is configured in such a way to move between said first and to said second working position by rotating about a rotational axis.

5. The machine for cleaning surfaces according to claim 3, wherein said obturator member comprises a supporting portion rotatably mounted about said rotational axis and provides:

a first closing portion positioned at a first predetermined position of said supporting portion, said first closing portion arranged to close said first inlet aperture in said second working position; and a second closing portion positioned at a second predetermined position of said supporting portion, said second closing portion arranged to close said second inlet aperture in said first working position.

6. The machine for cleaning surfaces according to claim 1, wherein said actuation device provides at least a control portion positioned at said handle portion, in such a way that said user can actuate the handle portion without letting go of said handle portion.

7. The machine for cleaning surfaces according to claim 6, wherein said control portion is operatively connected to said obturator member of said deviation device by an actuation element.

8. The machine for cleaning surfaces according to claim 1, wherein:

said actuation device provides a first control portion operatively connected to said obturator member of said deviation device by a first actuation element, and a second control portion operatively connected at least to said second squeegee element by a second actuation element, and at least one between said first and said second control portion is positioned at said handle portion.

9. The machine for cleaning surfaces according to claim 8, wherein said first and said second control portion are positioned at opposite sides with respect to a maneuvering bar arranged to connect said main body to said handle portion.

10. The machine for cleaning surfaces according to claim 8, wherein said, or each, actuation element is an actuation cable made of an inextensible material.

11. The machine for cleaning surfaces according to claim 6, wherein said control portion of said actuation device is operatively connected to said obturator member of said deviation device and at least to said second squeegee element by the same actuation cable made of inextensible material.

12. The machine for cleaning surfaces according to claim 7, wherein said actuation device provides a cam element fixed to said control portion by said actuation cable, said cam element being integral to said supporting portion, in such a way that when said user wishes to move backward said main body, said user acts on said control portion in order to cause said actuation cable to translate and, therefore, said supporting portion to rotate about said rotational axis.

13. The machine for cleaning surfaces according to claim 1, wherein said cleaning brush is actuated by a motion generation device in order to rotate about a rotational axis in a first sense of rotation, when said deviation device is arranged in said first working configuration, and in an opposite sense of rotation, when said deviation device is arranged in said second working configuration.

14. The machine for cleaning surfaces according to claim 1, wherein said actuation device is, furthermore, operatively connected to said first squeegee element, said actuation device being configured to position said first squeegee element in a position adjacent to said surface when said deviation device is arranged in said first working configuration, and in a position spaced from said surface, when said deviation device is positioned in said second working configuration.

15. The machine for cleaning surfaces according to claim 1, wherein are, furthermore, provided:

an additional actuation device configured to move at least said first squeegee element between a position adjacent to said surface to be cleaned, and a position spaced from said surface to be cleaned; and a blocking/unblocking device configured to move from a blocking configuration, in which is arranged to impede said movement at least of said first squeegee element between said position spaced and said position adjacent by said additional actuation device, and an unblocking configuration, in which is not arranged to impede said movement at least of said first squeegee element between said position spaced and said position adjacent by said additional actuation device.

16. The machine for cleaning surfaces according to claim 15, wherein said additional actuation device is configured to move also said second squeegee element between said position adjacent to said surface to be cleaned, and said position spaced from said surface to be cleaned.

17. The machine for cleaning surfaces according to claim 15, wherein an additional control portion is provided configured to actuate said additional actuation device.

18. The machine for cleaning surfaces according to claim 1, wherein said actuation device comprises a first engagement portion arranged to engage a second engagement portion of said support frame, said first engagement portion being configured to move from said surface to be cleaned to raise said second engagement portion and, therefore, to bring at least said first squeegee element in said position spaced from said surface, when said actuation device is actuated by said user, said first engagement portion being configured to move towards said surface to be cleaned to lower said second engagement portion and, therefore, to bring at least said first squeegee element in said position adjacent to said surface, when said actuation device is not actuated by said user.

19. The machine for cleaning surfaces according to claim 18, wherein said second engagement portion is curved and is arranged to rotate, together with said support frame about said rotational axis of said brush.

20. The machine for cleaning surfaces according to claim 1, wherein said main body comprises a base frame and at least a removable portion, said main body and said base frame providing, respectively, a first and a second engagement element configured to move from a disengagement position, in which it is possible to remove said, or each, removable portion, and an engagement position, in which said first and said second engagement element are arranged to prevent said, or each, removable portion from being removed from said base frame.

21. The machine for cleaning surfaces according to claim 20, wherein said, or each, removable portion is configured to form at least a containment body.

22. The machine for cleaning surfaces according to claim 20, wherein said first engagement element provides a protruding portion configured to face towards said base frame, in said engagement position, said protruding portion being arranged to engage in a recess provided on a lateral surface of said removable portion, in said disengagement position, said protruding portion being positioned outside of said recess.

23. The machine for cleaning surfaces according to claim 20, wherein said first engagement element is arranged to move from said engagement position to said disengagement position by rotating about a rotational axis in a first sense of rotation, and from said disengagement position to said engagement position by rotating about said rotational axis in a second sense of rotation opposite to said first sense of rotation.

* * * * *